US010287783B1

(12) United States Patent
Barczyk

(10) Patent No.: US 10,287,783 B1
(45) Date of Patent: May 14, 2019

(54) FLEXIBLE ADHESIVE WINDOW TRIM

(71) Applicant: Krzysztof Barczyk, Manchester, NJ (US)

(72) Inventor: Krzysztof Barczyk, Manchester, NJ (US)

( * ) Notice: Subject to any disclaimer, the term of this patent is extended or adjusted under 35 U.S.C. 154(b) by 0 days.

(21) Appl. No.: 15/944,277

(22) Filed: Apr. 3, 2018

(51) Int. Cl.
*E04F 19/02* (2006.01)

(52) U.S. Cl.
CPC ..... *E04F 19/02* (2013.01)

(58) Field of Classification Search
CPC ..... E04F 19/02; E06B 1/342
See application file for complete search history.

(56) References Cited

U.S. PATENT DOCUMENTS

| | | | | |
|---|---|---|---|---|
| 5,247,769 | A * | 9/1993 | Becker | B29C 63/0034 52/506.06 |
| 5,581,959 | A | 12/1996 | Occhipinti | |
| 5,699,637 | A | 12/1997 | Marocco | |
| 5,735,035 | A | 4/1998 | Holt | |
| D407,831 | S | 4/1999 | Gifford | |
| 6,981,348 | B2 | 1/2006 | Kjorsvik | |
| 7,797,884 | B2 | 9/2010 | Allen | |
| 2011/0088343 | A1 | 4/2011 | Smythe, Jr. | |

* cited by examiner

*Primary Examiner* — Patrick J Maestri

(57) ABSTRACT

The flexible adhesive window trim is configured for use with a window. The flexible adhesive window trim is a flexible trim structure. The flexible adhesive window trim will bend into a curved shape such that the flexible adhesive window trim aligns with the curvature of a curved window. The flexible adhesive window trim attaches to the wall containing the window using an adhesive.

13 Claims, 3 Drawing Sheets

FLEXIBLE ADHESIVE WINDOW TRIM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed construction and buildings, more specifically, a border construction for an opening in a wall with a curvilinear outline.

SUMMARY OF INVENTION

The flexible adhesive window trim is configured for use with a window. The flexible adhesive window trim is a flexible trim structure. The flexible adhesive window trim will bend into a curved shape such that the flexible adhesive window trim aligns with the curvature of a curved window. The flexible adhesive window trim attaches to the wall containing the window using an adhesive.

These together with additional objects, features and advantages of the flexible adhesive window trim will be readily apparent to those of ordinary skill in the art upon reading the following detailed description of the presently preferred, but nonetheless illustrative, embodiments when taken in conjunction with the accompanying drawings.

In this respect, before explaining the current embodiments of the flexible adhesive window trim in detail, it is to be understood that the flexible adhesive window trim is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flexible adhesive window trim.

It is therefore important that the claims be regarded as including such equivalent construction insofar as they do not depart from the spirit and scope of the flexible adhesive window trim. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
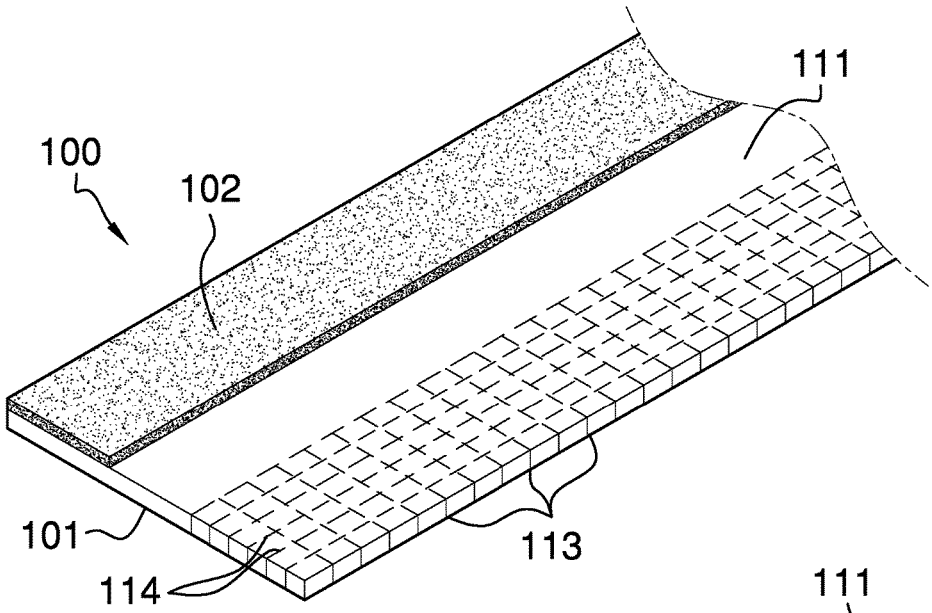
FIG. 1 is a perspective view of an embodiment of the disclosure.
Figure 2:
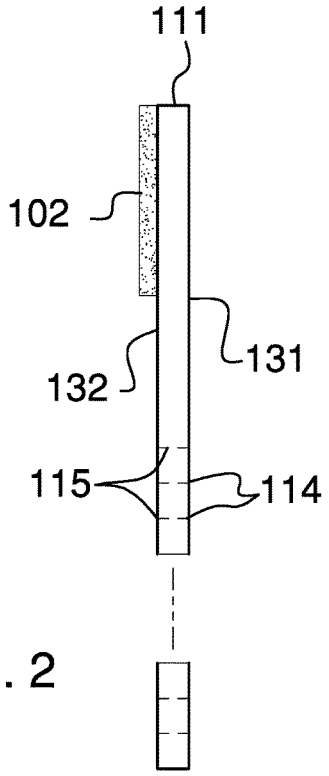
FIG. 2 is a side view of an embodiment of the disclosure.
Figure 3:
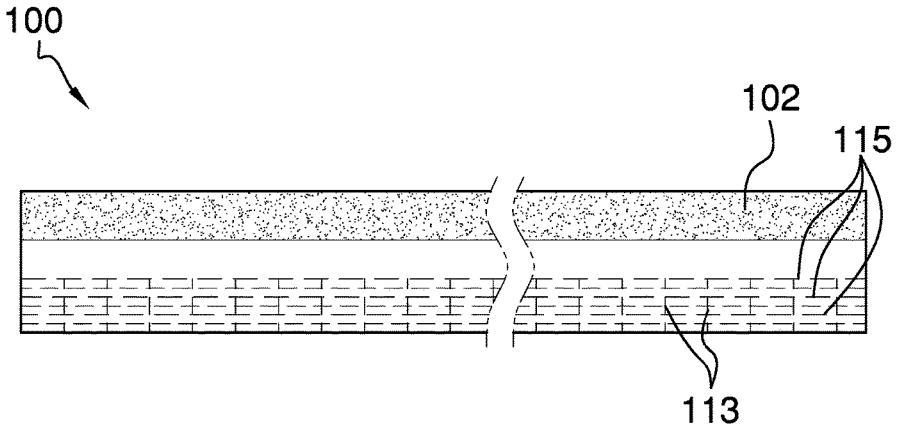
FIG. 3 is an interior surface view of an embodiment of the disclosure.
Figure 4:
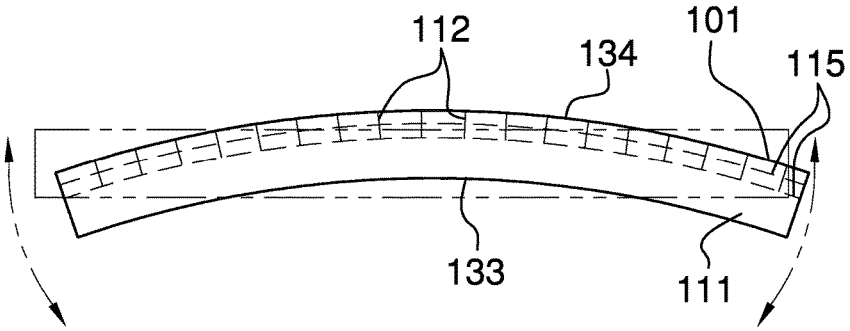
FIG. 4 is an exterior surface view of an embodiment of the disclosure.
Figure 5:
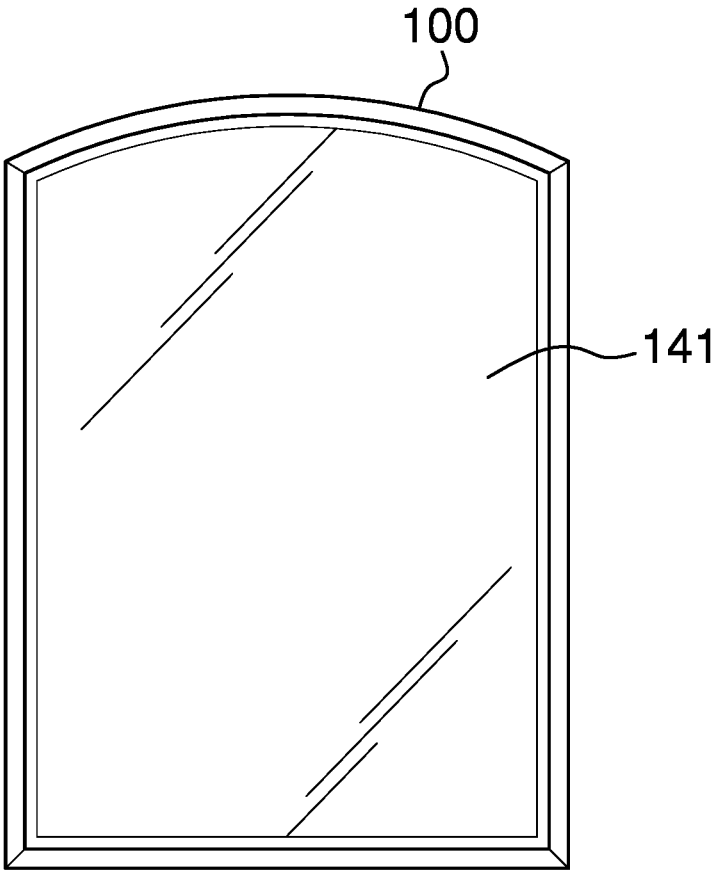
FIG. 5 is an in-use view of an embodiment of the disclosure.

Detailed reference will now be made to one or more potential embodiments of the disclosure, which are illustrated in FIGS. 1 through 5.

The flexible adhesive window trim 100 (hereinafter invention) is configured for use with a window 141. The invention 100 is a flexible trim structure 101. The invention 100 will bend into a curved shape such that the invention 100 aligns with the curvature of a curved window 141. The invention 100 attaches to the wall containing the window 141 using an adhesive 102.

The flexible trim structure 101 is a trim that is configured for use with a portal such as a window 141 or a door. The portal is hereinafter referred to as the window 141. The flexible trim structure 101 is a semi-rigid structure with an elastic nature. The flexible trim structure 101 deforms under a force such that a curve can be formed within the flexible trim structure 101 that matches a curvature formed in the window 141. By matching the curvature of the flexible trim structure 101 with the curvature of the window 141, the flexible trim structure 101 aligns with the window 141 during installation.

The flexible trim structure 101 is a polymer-based structure. The flexible trim structure 101 is molded as a single unit. The polymer selected for the flexible trim structure 101 is a UV resistant polymer. In the first potential embodiment of the disclosure, the polymer used to form the flexible trim structure 101 is selected from the group consisting of poly(methyl methacrylic) (CAS 9011-14-7) and 1,1difluoroethylene polymer (CAS 24937-79-9). The use of 1,1difluoroethylene polymer (CAS 24937-79-9) is preferred. The curing process of the selected polymer is minimized to reduce the number of polymer chain cross-links that would limit the elasticity and flexibility of the flexible trim structure 101.

The overall shape of the flexible trim structure 101 is a plate structure with a uniform thickness between the exterior surface 131 and the interior surface 132 of the flexible trim structure 101. The applicant prefers that the thickness of the plate structure of the flexible trim structure 101 be less than or equal to 0.125 inches (approximately 0.32 cm).

The flexible trim structure 101 comprises a base trim 111, an exterior kerf bending 112, an interior kerf bending 113, a plurality of exterior sizing scores 114, and a plurality of interior sizing scores 115. The base trim 111 is further defined with an exterior surface 131, an interior surface 132, an inner perimeter 133, and an outer perimeter 134.

The exterior surface 131 is the surface of the base trim 111 with the greatest surface area. The exterior surface 131 is the surface of the base trim 111 that is visible when the flexible trim structure 101 is installed normally. The interior surface 132 is the surface of the base trim 111 that is distal from the exterior surface 131. The outer perimeter 134 is the longest edge of the base trim 111. The outer perimeter 134 is the edge of the base trim 111 that forms the outer perimeter 134 of the base trim 111 when the invention 100 is installed around the curved edge of a window 141. The inner perimeter 133 is the edge of the base trim 111 that is distal from the outer perimeter 134.

The base trim 111 is a molded plate formed in the shape of a rectangular block. The thickness of the base trim 111 is measured as the distance between the exterior surface 131 and the interior surface 132 of the base trim 111. The base trim 111 has a uniform thickness. The polymer used in the formation of the base trim 111 provides the base trim 111 with a semi-rigid structure that has an elastic nature.

The performance of the semi-rigid structure of the base trim 111 is enhanced by the exterior kerf bending 112 and the interior kerf bending 113.

The exterior kerf bending 112 comprises a first plurality of slits.

Each slit formed for the exterior kerf bending 112 is perpendicular to both the inner perimeter 133 and the outer perimeter 134 of the base trim 111 when the base trim 111 is in its relaxed shape. Each slit formed for the exterior kerf bending 112 is formed through the outer perimeter 134 of the base trim 111 into the exterior surface 131 with a depth of: 1) more than one-third of the span of the distance between the exterior surface 131 and the interior surface 132; and, 2) of less than one half the span of the distance between the exterior surface 131 and the interior surface 132.

When the base trim 111 is curved such that the plane of the exterior surface 131 remains unchanged while an arc is formed in the inner perimeter 133 of the base trim 111, the exterior kerf bending 112 will "fan out" thereby allowing the outer perimeter 134 to form an arc that matches the arc formed by the inner perimeter 133 while simultaneously having a greater arc span than the outer perimeter 134.

The interior kerf bending 113 comprises a second plurality of slits. Each slit formed for the interior kerf bending 113 is perpendicular to both the inner perimeter 133 and the outer perimeter 134 of the base trim 111 when the base trim 111 is in its relaxed shape. Each slit formed for the interior kerf bending 113 is formed through the outer perimeter 134 of the base trim 111 into the interior surface 132 with a depth of: 1) more than one-third of the span of the distance between the interior surface 132 and the exterior surface 131; and, 2) of less than one half the span of the distance between the interior surface 132 and the exterior surface 131.

When the base trim 111 is curved such that the plane of the interior surface 132 remains unchanged while an arc is formed in the inner perimeter 133 of the base trim 111, the interior kerf bending 113 will "fan out" thereby allowing the outer perimeter 134 to form an arc that matches the arc formed by the inner perimeter 133 while simultaneously having a greater arc span than the outer perimeter 134.

The plurality of exterior sizing scores 114 comprises a third plurality of slits. Each slit formed for the plurality of exterior sizing scores 114 is parallel to both the inner perimeter 133 and the outer perimeter 134 of the base trim 111 when the base trim 111 is in its relaxed shape. Each slit formed for the plurality of exterior sizing scores 114 is formed into the exterior surface 131 of the base trim 111 with a depth of: 1) more than one-third of the span of the distance between the exterior surface 131 and the interior surface 132; and, 2) of less than one half the span of the distance between the exterior surface 131 and the interior surface 132.

The plurality of interior sizing scores 115 comprises a fourth plurality of slits. Each slit formed for the plurality of interior sizing scores 115 is parallel to both the inner perimeter 133 and the outer perimeter 134 of the base trim 111 when the base trim 111 is in its relaxed shape. Each slit formed for the plurality of interior sizing scores 115 is formed into the interior surface 132 of the base trim 111 with a depth of: 1) more than one-third of the span of the distance between the interior surface 132 and the exterior surface 131; and, 2) of less than one half the span of the distance between the interior surface 132 and the exterior surface 131.

The plurality of exterior sizing scores 114 and the plurality of interior sizing scores 115 are aligned with each other such that the span of the distance between the inner perimeter 133 of the base trim 111 and the outer perimeter 134 of the base trim 111 adjusts by "snapping" a portion of the base trim 111 off at an exterior score selected from the plurality of exterior sizing scores 114 and the associated interior score selected from the plurality of interior sizing scores 115.

The adhesive 102 is a chemical substance that attaches the interior surface 132 of the base trim 111 to a location selected from the group consisting of: 1) the window 141; and, 2) the structure the window 141 mounts in. The use of a permanent adhesive 102 is preferred. The adhesive 102 is applied as a rectangular surface on the interior surface 132 of the base trim 111 along the inner perimeter 133. In the first potential embodiment of the disclosure, the adhesive 102 is a commercially available double-sided tape.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Arc: As used in this disclosure, an arc refers to a portion of a circumference or a curved perimeter. When applied to an angle, the arc also refers to a measure of an angular span as measured from a circle at the vertex formed by the sides of the angle.

Curve or Curvature: As used in this disclosure, a curve refers to a continuous line that is not a straight line or a continuous surface that is not a planar surface. By continuous is meant that the continuous line or surface changes smoothly over one or more independent variables. Alternately, continuous can be taken to mean that a single-valued derivative with respect to any independent variable exists for all points on the curved line or curved surface. A note on usage: within this disclosure, when a prism is said to be curved, what will be meant is that the center axis of the prism is curved. The discontinuities inherent in the ends of the prism will continue to exist in the lateral face of the curved prism.

PDFE: As used in this disclosure, PDFE is an acronym for the 1,1difluoroethylene polymer (CAS 24937-79-9) which is formed from the 1,1difluoroethene (CAS 75-38-7) monomer. Elastic: As used in this disclosure, an elastic is a material or object that deforms when a force is applied to it and that is able to return to its relaxed shape after the force is removed. A material that exhibits these qualities is also referred to as an elastomeric material.

Flexible: As used in this disclosure, flexible refers to an object or material that will deform when a force is applied to it but that will not necessarily return to its original shape when the deforming force is removed.

Flexure Bearing: As used in this disclosure, a flexure bearing is a thin and flexible material that is used to attach, or bind, a first object to a second object such that the first object can rotate in a controlled direction relative to the second object.

Inner Perimeter and Outer Perimeter: As used in this disclosure, the inner perimeter and the outer perimeter refer to two geometrically similar structures of a curved object. The inner perimeter refers to the geometrically similar structure with the shorter span. The outer perimeter refers to the geometrically similar structure with the greater span.

Living Hinge: As used in this disclosure, refers to a single object formed out of an elastomeric material that is divided into a first segment, a second segment, and the living hinge. The elastic nature of the elastomeric material allows the living hinge to be flexed in the manner of a hinge allowing the first segment to rotate relative to the second hinge. The living hinge is a form of a flexure bearing. A material formed with a series of parallel living hinges is referred to as a kerf bending. A kerf bending formed in a plate allows the plate to be bent into a curved shape.

Mold: As used in this disclosure, a mold is a container with a specific shape into which a liquid is contained. After the liquid cools to a solid phase, the solid phase of the liquid maintains the shape of the mold after removal. When used as a verb, to mold means to use a mold to create the shape of the solid. Polymer materials are often shaped using a mold.

Monomer: As used in this disclosure, a monomer refers to a molecular structure that bonds to itself in a repeating manner to form a polymer.

PDFE: As used in this disclosure, PDFE is an acronym for the 1,1difluoroethylene polymer (CAS 24937-79-9) which is formed from the 1,1difluoroethene (CAS 75-38-7) monomer.

Plate: As used in this disclosure, a plate is a smooth, flat and rigid object that has at least one dimension that: 1) is of uniform thickness; and 2) that appears thin relative to the other dimensions of the object. Plates often have a rectangular or disk-like appearance.

Polymer: As used in this disclosure, a polymer refers to a molecular chain that comprises multiple repeating units known as monomers. The repeating unit may be an atom or a molecular structure.

Radial: As used in this disclosure, the term radial refers to a direction that: 1) is perpendicular to an identified central axis; or, 2) projects away from a center point.

Rectangular Block: As used in this disclosure, a rectangular block refers to a three-dimensional structure comprising six rectangular surfaces formed at right angles. Within this disclosure, a rectangular block may further comprise rounded edges and corners.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Strip: As used in this disclosure, the term describes a long thin object of uniform width. Strips are often rectangular blocks in shape.

Tape: As used in this disclosure, tape refers to a flexible and narrow strip of textile or sheeting that fastens, secures, or strengthens an object.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A trim item comprising:

a flexible trim structure and an adhesive;

wherein the adhesive attaches to the flexible trim structure;

wherein the trim item is configured for use with a portal;

wherein the flexible trim structure bends into a curved shape such that the trim item aligns with a curvature of the portal;

wherein the flexible trim structure is a semi-rigid structure with an elastic nature;

wherein the flexible trim structure deforms under a force such that a curve can be formed within the flexible trim structure that matches the curvature formed in the portal;

wherein the flexible trim structure is a polymer-based structure;

wherein the flexible trim structure has a plate structure;

wherein the plate structure has a uniform thickness;

wherein the flexible trim structure comprises a base trim, an exterior kerf bending, an interior kerf bending, a plurality of exterior sizing scores, and a plurality of interior sizing scores;

wherein the exterior kerf bending, the interior kerf bending, the plurality of exterior sizing scores, and the plurality of interior sizing scores are formed in the base trim;

wherein the base trim is further defined with an exterior surface, an interior surface, an inner perimeter, and an outer perimeter.

2. The trim item according to claim 1 wherein the base trim is a molded plate formed in the shape of a rectangular block;

wherein the thickness of the base trim is measured as the distance between the exterior surface and the interior surface of the base trim;

wherein the base trim has a uniform thickness.

3. The trim item according to claim 2 wherein the exterior kerf bending comprises a first plurality of slits;

wherein the interior kerf bending comprises a second plurality of slits;

wherein each slit formed for the exterior kerf bending is perpendicular to both the inner perimeter and the outer perimeter of the base trim when the base trim is in its relaxed shape;

wherein each slit formed for the interior kerf bending is perpendicular to both the inner perimeter and the outer perimeter of the base trim when the base trim is in its relaxed shape.

4. The trim item according to claim 3 wherein each slit formed for the exterior kerf bending is formed through the outer perimeter of the base trim into the exterior surface with a depth of: a) more than one-third of the span of the distance between the exterior surface and the interior surface; and, b) of less than one half the span of the distance between the exterior surface and the interior surface;

wherein each slit formed for the interior kerf bending is formed through the outer perimeter of the base trim into the interior surface with a depth of: a) more than one-third of the span of the distance between the interior surface and the exterior surface; and, b) of less than one half the span of the distance between the interior surface and the exterior surface.

5. The trim item according to claim 4 wherein when the base trim is curved such that the plane of the exterior surface remains unchanged while an arc is formed in the inner perimeter of the base trim, the exterior kerf bending will fan out thereby allowing the outer perimeter to form an arc that matches the arc formed by the inner perimeter while simultaneously having a greater arc span than the outer perimeter;

wherein when the base trim is curved such that the plane of the interior surface remains unchanged while an arc is formed in the inner perimeter of the base trim, the interior kerf bending will fan out thereby allowing the outer perimeter to form an arc that matches the arc formed by the inner perimeter while simultaneously having a greater arc span than the outer perimeter.

6. The trim item according to claim 5 wherein the plurality of exterior sizing scores comprises a third plurality of slits;

wherein the plurality of interior sizing scores comprises a fourth plurality of slits;

wherein each slit formed for the plurality of exterior sizing scores is parallel to both the inner perimeter and the outer perimeter of the base trim when the base trim is in its relaxed shape;

wherein each slit formed for the plurality of interior sizing scores is parallel to both the inner perimeter and the outer perimeter of the base trim when the base trim is in its relaxed shape.

7. The trim item according to claim 6 wherein each slit formed for the plurality of exterior sizing scores is formed into the exterior surface of the base trim with a depth of: a) more than one-third of the span of the distance between the exterior surface and the interior surface; and, b) of less than one half the span of the distance between the exterior surface and the interior surface;

wherein each slit formed for the plurality of interior sizing scores is formed into the interior surface of the base trim with a depth of: a) more than one-third of the span of the distance between the interior surface and the exterior surface; and, b) of less than one half the span of the distance between the interior surface and the exterior surface.

8. The trim item according to claim 7 wherein the plurality of exterior sizing scores and the plurality of interior sizing scores are aligned with each other such that the span of the distance between the inner perimeter of the base trim and the outer perimeter of the base trim adjusts by snapping a portion of the base trim off at an exterior score selected from the plurality of exterior sizing scores and the associated interior score selected from the plurality of interior sizing scores.

9. The trim item according to claim 8 wherein the adhesive is a chemical substance that attaches the interior surface of the base trim to a location selected from the group consisting of: a) the portal; and, b) a structure the portal mounts in.

10. The trim item according to claim 9 wherein the adhesive is applied as a rectangular surface on the interior surface of the base trim along the inner perimeter.

11. The trim item according to claim 10 wherein the adhesive is a double-sided tape.

12. The trim item according to claim 10 wherein the polymer used to form the flexible trim structure is 1,1-difluoroethylene polymer (CAS 24937-79-9).

13. The trim item according to claim 10 wherein the polymer used to form the flexible trim structure is selected from the group consisting of poly(methyl methacrylic) (CAS 9011-14-7).

* * * * *